US009447531B2

(12) United States Patent
McAmish et al.

(10) Patent No.: US 9,447,531 B2
(45) Date of Patent: Sep. 20, 2016

(54) PROCESS FOR PRODUCING NONWOVEN FABRIC

(71) Applicant: Imerys Pigments, Inc., Roswell, GA (US)

(72) Inventors: Larry H. McAmish, Marietta, GA (US); David A. Skelhorn, Alpharetta, GA (US)

(73) Assignee: Imerys Pigments, Inc., Roswell, GA (US)

( * ) Notice: Subject to any disclaimer, the term of this patent is extended or adjusted under 35 U.S.C. 154(b) by 161 days.

(21) Appl. No.: 13/967,111

(22) Filed: Aug. 14, 2013

(65) Prior Publication Data

US 2014/0070443 A1 Mar. 13, 2014

Related U.S. Application Data

(62) Division of application No. 12/520,103, filed as application No. PCT/US2008/053964 on Feb. 14, 2008, now abandoned.

(60) Provisional application No. 60/941,684, filed on Jun. 3, 2007, provisional application No. 60/969,100, filed on Aug. 30, 2007.

(51) Int. Cl.

| | |
|---|---|
| ***D01D 1/02*** | (2006.01) |
| ***D01D 1/04*** | (2006.01) |
| ***D01D 5/08*** | (2006.01) |
| ***D01D 5/098*** | (2006.01) |
| ***D01D 5/12*** | (2006.01) |
| ***D01D 5/14*** | (2006.01) |
| ***D01D 7/00*** | (2006.01) |
| ***D01F 1/02*** | (2006.01) |
| ***D01F 1/04*** | (2006.01) |
| ***D04H 3/08*** | (2006.01) |
| ***D04H 3/10*** | (2012.01) |
| ***D04H 3/11*** | (2012.01) |
| ***D04H 3/14*** | (2012.01) |
| ***D04H 3/105*** | (2012.01) |
| ***D04H 3/16*** | (2006.01) |

(52) U.S. Cl.

CPC ..... *D04H 3/14* (2013.01); *D01D 5/0985* (2013.01); *D04H 3/102* (2013.01); *D04H 3/105* (2013.01); *D04H 3/16* (2013.01)

(58) Field of Classification Search

CPC ..... D01D 1/02; D01D 1/04; D01D 5/08; D01D 5/098; D01D 5/0985; D01D 5/12; D01D 5/14; D01D 7/00; D01F 1/02; D01F 1/10; D04H 3/08; D04H 3/10; D04H 3/102; D04H 3/105; D04H 3/11; D04H 3/16

USPC ..... 264/103, 210.6, 210.8, 211, 211.12, 264/555; 156/167, 181

See application file for complete search history.

(56) References Cited

U.S. PATENT DOCUMENTS

| | | | |
|---|---|---|---|
| 3,160,598 | A | 12/1964 | Delfosse |
| 3,692,618 | A | 9/1972 | Dorschner et al. |
| 3,802,817 | A | 4/1974 | Matsuki et al. |
| 3,849,241 | A | 11/1974 | Butin et al. |
| 4,083,829 | A | 4/1978 | Calundann et al. |
| 4,161,470 | A | 7/1979 | Calundann |
| 4,184,996 | A | 1/1980 | Calundann |
| 4,219,461 | A | 8/1980 | Calundann |
| 4,254,182 | A | 3/1981 | Yamaguchi et al. |
| 4,256,624 | A | 3/1981 | Calundann |
| 4,279,803 | A | 7/1981 | Calundann |
| 4,318,841 | A | 3/1982 | East et al. |
| 4,330,457 | A | 5/1982 | East et al. |
| 4,337,190 | A | 6/1982 | Calundann |
| 4,339,375 | A | 7/1982 | Calundann et al. |
| 4,340,563 | A | 7/1982 | Appel et al. |
| 4,351,917 | A | 9/1982 | Calundann et al. |
| 4,351,918 | A | 9/1982 | Charbonneau et al. |
| 4,355,132 | A | 10/1982 | East et al. |
| 4,355,134 | A | 10/1982 | Charbonneau et al. |
| 4,375,530 | A | 3/1983 | Hay et al. |
| 4,393,191 | A | 7/1983 | East |
| 4,411,854 | A | 10/1983 | Maurer et al. |

(Continued)

FOREIGN PATENT DOCUMENTS

| | | | |
|---|---|---|---|
| CN | 1522198 | A | 8/2004 |
| CN | 1796651 | A | 7/2006 |

(Continued)

OTHER PUBLICATIONS

Office Action dated May 31, 2013, for related U.S. Appl. No. 12/863,341, filed Jul. 16, 2010.

Office Action dated Jun. 19, 2013, for related U.S. Appl. No. 13/460,494, filed Apr. 30, 2012.

Office Action dated Jun. 5, 2013, for related U.S. Appl. No. 12/874,761, filed Sep. 2, 2010.

Pastore, Christopher M., and Kiekens, Paul, "Surface Characteristics of Fibers and Textiles", Surfactant Science Series; vol. 94, 2001, 6 (selected) pgs.

(Continued)

*Primary Examiner* — Leo B Tentoni

(74) *Attorney, Agent, or Firm* — Finnegan, Henderson, Farabow, Garrett & Dunner LLP

(57) ABSTRACT

Described herein are spunlaid fibers including at least one polymeric resin and at least one filler having an average particle size of less than or equal to about 5 microns and/or having a top cut of less than about 15 microns. The at least one filler may be present in an amount of less than about 40% by weight, relative to the total weight of the spunlaid fibers. Also described herein is a method for producing spunlaid fibers including adding calcium carbonate to at least one polymeric resin and extruding the resulting mixture. Further described herein are nonwoven fabrics including such spunlaid fibers, and methods for producing them.

24 Claims, 21 Drawing Sheets

(56) References Cited

U.S. PATENT DOCUMENTS

| | | | | |
|---|---|---|---|---|
| 4,421,908 | A | 12/1983 | East | |
| 4,429,105 | A | 1/1984 | Charbonneau | |
| 4,444,921 | A | 4/1984 | South, Jr. | |
| 4,473,682 | A | 9/1984 | Calundann et al. | |
| 4,522,974 | A | 6/1985 | Calundann et al. | |
| 4,801,494 | A | 1/1989 | Datta et al. | |
| 4,898,620 | A | 2/1990 | Rayfield et al. | |
| 4,929,303 | A | 5/1990 | Sheth | |
| 5,166,238 | A | 11/1992 | Nakano et al. | |
| 5,194,319 | A | 3/1993 | Onaka et al. | |
| 5,204,443 | A | 4/1993 | Lee et al. | |
| 5,212,223 | A | 5/1993 | Mack et al. | |
| 5,213,866 | A | 5/1993 | Swope et al. | |
| 5,236,963 | A * | 8/1993 | Jacoby et al. | 521/92 |
| 5,427,595 | A | 6/1995 | Pihl et al. | |
| 5,460,884 | A | 10/1995 | Kobylivker et al. | |
| 5,662,978 | A | 9/1997 | Brown et al. | |
| 5,688,582 | A * | 11/1997 | Nagaoka et al. | 428/198 |
| 5,720,832 | A | 2/1998 | Minto et al. | |
| 5,762,840 | A * | 6/1998 | Tsai et al. | 264/210.6 X |
| 5,766,760 | A | 6/1998 | Tsai et al. | |
| 5,817,584 | A | 10/1998 | Singer et al. | |
| 6,218,011 | B1 | 4/2001 | Raetzsch et al. | |
| 6,329,465 | B1 | 12/2001 | Takahashi et al. | |
| 6,342,100 | B1 | 1/2002 | Nover et al. | |
| 6,740,386 | B2 | 5/2004 | Hutchison | |
| 6,759,124 | B2 | 7/2004 | Royer et al. | |
| 6,759,357 | B1 | 7/2004 | Toriumi | |
| 6,797,377 | B1 | 9/2004 | DeLucia et al. | |
| 6,811,865 | B2 | 11/2004 | Morman et al. | |
| 7,060,746 | B2 | 6/2006 | Calhoun et al. | |
| 7,270,723 | B2 | 9/2007 | McCormack et al. | |
| 7,309,522 | B2 | 12/2007 | Webb et al. | |
| 7,338,916 | B2 | 3/2008 | Rollin, Jr. | |
| 2002/0071944 | A1 | 6/2002 | Gardner et al. | |
| 2002/0161123 | A1* | 10/2002 | Li | D01F 6/46 525/178 |
| 2003/0024625 | A1 | 2/2003 | McAmish et al. | |
| 2003/0203695 | A1 | 10/2003 | Polanco et al. | |
| 2004/0005457 | A1* | 1/2004 | DeLucia et al. | 428/364 |
| 2004/0091752 | A1 | 5/2004 | Morman et al. | |
| 2004/0147636 | A1 | 7/2004 | Calhoun et al. | |
| 2004/0186214 | A1 | 9/2004 | Li et al. | |
| 2005/0101739 | A1 | 5/2005 | Webb et al. | |
| 2005/0165193 | A1 | 7/2005 | Patel et al. | |
| 2005/0227563 | A1 | 10/2005 | Bond | |
| 2006/0020056 | A1 | 1/2006 | Dombrowski et al. | |
| 2006/0084346 | A1 | 4/2006 | Rollin, Jr. | |
| 2006/0199006 | A1 | 9/2006 | Poon et al. | |
| 2007/0087159 | A1 | 4/2007 | Wright | |
| 2007/0122614 | A1 | 5/2007 | Peng et al. | |
| 2007/0269654 | A1 | 11/2007 | Veillat et al. | |
| 2008/0081862 | A1 | 4/2008 | Lustiger et al. | |
| 2009/0104831 | A1 | 4/2009 | Bornemann et al. | |
| 2009/0156727 | A1 | 6/2009 | Bensason et al. | |
| 2010/0184348 | A1 | 7/2010 | McAmish et al. | |
| 2011/0052913 | A1 | 3/2011 | McAmish | |

FOREIGN PATENT DOCUMENTS

| | | | |
|---|---|---|---|
| DE | 39 27 861 | A1 | 3/1990 |
| EP | 0 080 382 | A2 | 6/1983 |
| EP | 0 055 001 | B1 | 4/1985 |
| EP | 0 908 549 | A1 | 4/1999 |
| EP | 0 880 610 | B1 | 10/2001 |
| EP | 1 350 869 | A1 | 10/2003 |
| EP | 0 841 415 | B1 | 2/2004 |
| EP | 1 512 719 | A1 | 3/2005 |
| GB | 1 328 090 | | 8/1973 |
| GB | 1 477 642 | | 6/1977 |
| JP | 57-205515 | A1 | 12/1982 |
| JP | 59-211611 | A2 | 11/1984 |
| JP | 6-184905 | | 7/1994 |
| JP | 09-208730 | | 8/1997 |
| JP | 10-168726 | A | 6/1998 |
| JP | 11-012400 | | 1/1999 |
| KR | 2003-0066189 | A | 8/2003 |
| WO | WO 97/30199 | | 8/1997 |
| WO | WO 97/39169 | | 10/1997 |
| WO | WO 98/03706 | | 1/1998 |
| WO | WO 98/16672 | | 4/1998 |
| WO | WO 98/29247 | A1 | 7/1998 |
| WO | WO 98/29481 | | 7/1998 |
| WO | WO 98/29482 | | 7/1998 |
| WO | WO 01/05588 | A1 | 1/2001 |
| WO | WO 03/093543 | A1 | 11/2003 |
| WO | WO 2005/108665 | A1 | 11/2005 |
| WO | WO 2006/608253 | A1 | 6/2006 |
| WO | WO 2007/124866 | A1 | 11/2007 |
| WO | WO 2008/077156 | A2 | 6/2008 |
| WO | WO 2009/094321 | A1 | 7/2009 |

OTHER PUBLICATIONS

Ruiz, F. A., "High Performance Mineral Reinforcement Concentrate for LLDPE & HMW-HDPE Blown Film Extrusion", Journal of Plastic Film and Sheeting, vol. 18, 2002, pp. 25-29.

Omya OMYACARB® UF—FL Calcium Carbonate Technical Data Sheet, printed 12/30/113.

Third Party Observation issued Oct. 24, 2013, by the European Patent Office in corresponding Application No. EP 09703413.6, 8 pgs.

Office Action issued Nov. 21, 2013, in corresponding Chinese Application No. CN 201080049758.4, 18 pgs.

Office Action issued Jan. 2, 2014, in co-pending U.S. Appl. No. 13/460,494, filed Apr. 30, 2012.

Office Action issued Dec. 16, 2013, in related U.S. Appl. No. 12/554,371, filed Sep. 4, 2009.

Office Action issued Nov. 4, 2013, in related U.S. Appl. No. 12/874,761, filed Sep. 2, 2010.

Nago, Satoshi, and Mizutani, Yukio, "Microporous Polypropylene Fibers Containing $CaCO_3$ Fillers", Journal of Applied Polymer Science, vol. 62, 1996, pp. 81-86.

Tsai, Peter P.; Schreuder-Gibson, Heidi; and Gibson, Phillip, "Different electrostatic methods for making electret filters", Journal of Electrostatics, vol. 54, 2002, pp. 333-341.

*Spunbond Technology Today 2—Onstream in the 90's*, Miller Freeman, Inc., 1992, pp. 11-16.

*Encyclopedia of Polymer Science and Engineering*, John Wiley and Sons, vol. 10, 1987.

"*The Nonwovens Handbook*", Association of Nonwoven Fabrics Industry, 1988.

Rothon, Roger N., "Particulate-Filled Polymer Composites", 2nd Ed. Rapra Technology, 2003, pp. 60-61, 167, 171-172,224-227, 404-408, & 419.

Roussel, M.D., Guy, A.R., Shaw, L. G., and Cara, J. E., "The Use of Calcium Carbonate in Polyolefins Offers Significant Improvement in Productivity", http://www.tappi.org/content/enewsletters/eplace/2006/06-3Rousselv1.pdf 2005 European Place Conference.

Guy, Allen R., Cara, James E., Shaw, Lane G., and Roussel, Michael D., "Calcium Carbonates for Polyolefin Extrusion Coating Applications", http://www.tappi.org/Downloads/unsorted/UNTITLED---PLA0479pdf/aspx, Guy, A.R., "Calcium, Carbonates for Polyolefin Extrusion Coating Applications", TAPPI Polymers, Laminations, and Coatings Conference Proceedings 2004.

Xanthos, Marina, "Functional Fillers for Plastics", WILEY-VCH 2005, pp. 3-6, 8-10, 34, 41-43, 105-110.

List of dry, uncoated precipitated Calcium Carbonate from www.mineralstech.com/index.php?id=111.

Performance Minerals for Paper, "Albaglos Dry" Precipitated Calcium Carbonate (PCC) Data Sheet, 2003.

Michlik, Peter; Diacikova, Anna; Karnis, Jozef; Knotek, Lubomir, "Modifying the density of polypropylene fibres by adding microground limestone", Chemické Vlákna, No. 1, 1987, XXXVII, pp. 37-45.

Papirer, E., Schultz, J. and Turchi, C., "Surface Properties of a Calcium Carbonate Filler Treated with Stearic Acid", Eur. Polymer Journal, vol. 20, No. 12, 1984.

OMYA BSH Data Sheet, 1979.

ALBAGLOS Data Sheet, 1998.

(56) References Cited

OTHER PUBLICATIONS

OMYACARB Technical Data Sheet for Product Range and OMYACARB F-FL Calcium Carbonate Technical Data Sheet, accessed Dec. 14, 2012.
Office Action dated Jan. 18, 2013, for related U.S. Appl. No. 13/460,494, filed Apr. 30, 2012.
Office Action dated Dec. 21, 2012, for related U.S. Appl. No. 12/863,341, filed Jul. 16, 2010.
Omyalene 102 M in PO Pipes, Review, Technical Information Plastics R4-04, Technology Plastics, Omya AG, Oftringen, Switzerland, pp. 1-4.
European Search Report for EP Application No. 08729862.6, dated Apr. 26, 2010.
Office Action dated Apr. 23, 2012, for related U.S. Appl. No. 12/874,761, filed Sep. 2, 2010.
Office Action dated Apr. 20, 2012, for related U.S. Appl. No. 12/554,371, filed Sep. 4, 2009.
Office Action dated Oct. 5, 2012, for related U.S. Appl. No. 12/874,761, filed Sep. 2, 2010.
Office Action dated Oct. 3, 2012, for related U.S. Appl. No. 12/554,371, filed Sep. 4, 2009.
Office Action dated Sep. 7, 2012, for related U.S. Appl. No. 13/460,494, filed Apr. 30, 2012.
Examination Report dated Jul. 18, 2012, for related EP Application No. 11180514, filed Sep. 8, 2011.
Omya OMYACARB FT HS-FL Calcium Carbonate; copyright 1996-2012 by MatWEb, LLC; www.matweb.com/.../GetMatIsByTradename.aspx? . . . OMYACARB.
Magnum Gloss® M Precipitated Calcium Carbonate, 2006.
Performance Minerals for Paper, ALBAGLOS® S Precipitated Calcium Carbonate, 2003.
International Search Report and Written Opinion dated Mar. 16, 2009, for International Application No. PCT/US2009/031397.
International Search Report and Written Opinion dated Nov. 2, 2010, for PCT Application No. PCT/US2010/47722.
Extended Search Report for related EP Application No. EP 11180514.9, dated Nov. 18, 2011.
International Search Report and Written Opinion dated May 23, 2008, for PCT Application No. PCT/US2008/053964.
Search Report by European Patent Office for European Patent Application No. EP15167394.4 dated Dec. 18, 2015.

* cited by examiner

PROCESS FOR PRODUCING NONWOVEN FABRIC

RIGHT OF PRIORITY AND INCORPORATION BY REFERENCE

This is a divisional of U.S. application Ser. No. 12/520,103, filed Aug. 14, 2009, abandoned, which is a U.S. national stage entry under 35 U.S.C. §371 from PCT International Application No. PCT/US2008/053964, filed Feb. 14, 2008, and claims priority to and the benefit of U.S. Provisional Patent Application Nos. 60/969,100, filed Aug. 30, 2007, 60/941,684, filed Jun. 3, 2007, 60/870,861, filed Dec. 20, 2006, and PCT International Application No. PCT/US2007/087919, filed Dec. 18, 2007, all of which are incorporated herein by reference in their entireties.

FIELD OF THE INVENTION

Disclosed herein are spunlaid fibers comprising less than about 40 wt % of coated calcium carbonate, relative to the total weight of the fibers. Also disclosed herein is a method for producing spunlaid fibers comprising adding coated calcium carbonate to at least one polymeric resin and extruding the resulting mixture to then form the fibers. Further disclosed herein are nonwoven fabrics and products comprising such spunlaid fibers and methods for producing them.

BACKGROUND OF THE INVENTION

Many nonwoven commercial products are formed from spunlaid fibers of polymeric resins. For instance, spunlaid fibers may be used to make diapers, feminine hygiene products, adult incontinence products, packaging materials, wipes, towels, dust mops, industrial garments, medical drapes, medical gowns, foot covers, sterilization wraps, table cloths, paint brushes, napkins, trash bags, various personal care articles, ground cover, and filtration media.

Spunlaid fibers are generally made by a continuous process, in which the fibers are spun and dispersed in a nonwoven web. Two examples of spunlaid processes are spunbonding or meltblowing. In particular, spunbonded fibers may be produced by spinning a polymeric resin into the shape of a fiber, for example, by heating the resin at least to its softening temperature, extruding the resin through a spinerette to form fibers, and transferring the fibers to a fiber draw unit to be collected in the form of spunlaid webs. Meltblown fibers may be produced by extruding the resin and attenuating the streams of resin by hot air to form fibers with a fine diameter and collecting the fibers to form spunlaid webs.

The textile industry consumes a large amount of thermoplastic polymeric resin each year for the production of nonwoven products. While it is known to incorporate various mineral fillers such as calcium carbonate and kaolin during production of nonwoven products and plastic products such as films and molded parts, it is not general practice to include large amounts of such fillers in polymeric nonwoven fibers. Previously, the cost of virgin resin was lower than the cost of concentrates composed of resins and mineral fillers and, thus, there was not a recognized need to incorporate significant amounts of such fillers into nonwoven products. However, due to recent increases in resin prices, there is now a cost benefit associated with increasing the quantity of mineral fillers and decreasing the quantity of resin in nonwoven products. By incorporating an optimum amount of at least one mineral filler, such as coated calcium carbonate, it is possible to reduce the required amount of virgin resin material while still producing a nonwoven product having comparable quality in terms of fiber strength, texture, and/or appearance.

The prior art appears to disclose nonwoven products comprising various amounts of inorganic compounds and/or mineral fillers. For example, U.S. Pat. No. 6,797,377 appears to disclose nonwoven webs comprising from 0.1 to 10 wt % of at least one mineral filler such as calcium carbonate, but imposes the limitation of the filler being used in conjunction with titanium dioxide in a mixture of at least two resin polymers. U.S. Pat. No. 6,759,357 likewise appears to disclose nonwoven fabrics comprising from 0.0015 to 0.09 wt % of at least one inorganic compound. S. Nago and Y. Mizutani, "Microporous Polypropylene Fibers Containing $CaCO_3$ Filler," 62 J. Appl. Polymer Sci. 81-86 (1996), also appears to discuss polypropylene-based nonwoven fibers comprising 25 wt % calcium carbonate. WO 97/30199 may disclose fibers consisting essentially of 0.01 to 20 wt % inorganic particles, substantially all having a Mohs hardness of less than about 5 and at least 90 wt % of the inorganic particles having a particle size of less than 10 microns. However, those references do not appear to disclose reducing the impact of the filler on the properties of the nonwoven fibers at least through changes to the particle size of the coated calcium carbonate by its average particle size and/or by its top cut.

Thus, it would be useful to provide spunlaid fibers that incorporate higher levels of coated calcium carbonate, thereby allowing for more cost-effective nonwoven products that have comparable quality in terms of strength, texture, and/or appearance.

SUMMARY OF THE INVENTION

Figure 1:
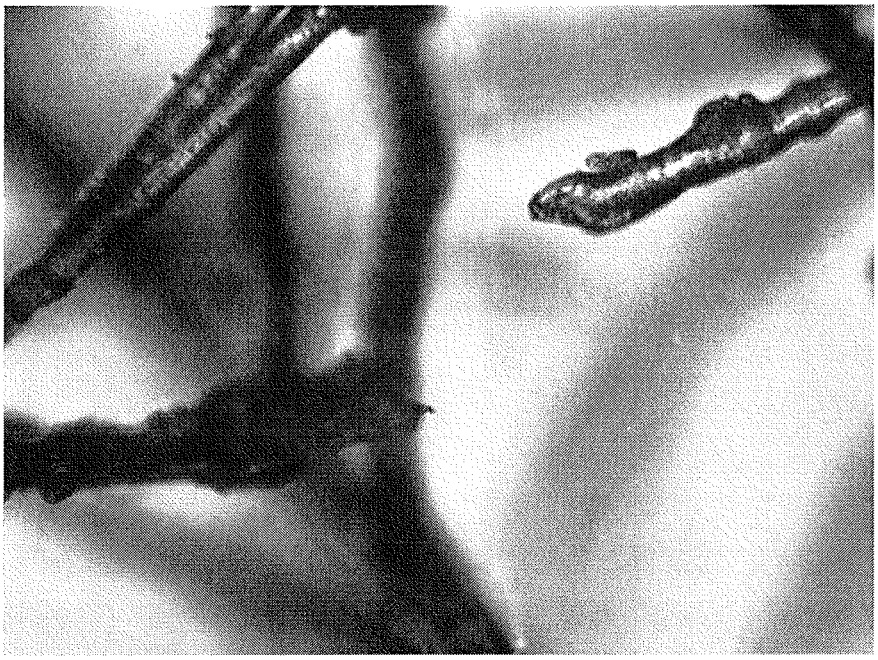
FIG. 1 is an SEM photograph of fibers made with 20% coated calcium carbonate having a top cut of about 20 showing fiber breakage.

Disclosed herein are spunlaid fibers comprising at least one polymeric resin and coated calcium carbonate having an average particle size less than or equal to about 5 microns, wherein the calcium carbonate is present in an amount of less than about 40% by weight, relative to the total weight of the fibers.

In addition, disclosed herein are spunlaid fibers comprising at least one polymeric resin and coated calcium carbonate having a top cut of about 15 microns or less, wherein the coated calcium carbonate is present in an amount of less than about 40% by weight, relative to the total weight of the fibers.

Also disclosed herein is a method for producing spunlaid fibers comprising adding coated calcium carbonate to at least one polymeric resin and extruding the resulting mixture, wherein the coated calcium carbonate has an average particle size less than or equal to about 5 microns, and wherein the coated calcium carbonate is present in the final product in an amount of less than about 40% by weight. Further disclosed herein is a method for producing spunlaid fibers comprising at least one polymeric resin and coated calcium carbonate having a top cut of about 15 microns or less, wherein the coated calcium carbonate is present in an amount of less than about 40% by weight, relative to the total weight of the fibers.

Further disclosed herein are nonwoven fabrics and products comprising such spunlaid fibers, and methods for producing those fabrics and products.

DETAILED DESCRIPTION OF THE INVENTION

Nonwoven Fibers

At Least One Polymeric Resin

Disclosed herein are spunlaid fibers and products comprising increased amounts of coated calcium carbonate filler. The spunlaid fibers disclosed herein comprise at least one polymeric resin. In one embodiment, the at least one polymeric resin is chosen from conventional polymeric resins that provide the properties desired for any particular nonwoven product or application. In another embodiment, the at least one polymeric resin is chosen from thermoplastic polymers, including but not limited to: polyolefins, such as polypropylene and polyethylene homopolymers and copolymers, including copolymers with 1-butene, 4-methyl-1-pentene, and 1-hexane; polyamides, such as nylon; polyesters; copolymers of any of the above-mentioned polymers; and blends thereof.

Examples of commercial products suitable as the at least one polymeric resin include, but are not limited to: Exxon 3155, a polypropylene homopolymer having a melt flow rate of about 30 g/10 min, available from Exxon Mobil Corporation; PF 305, a polypropylene homopolymer having a melt flow rate of about 38 g/10 min, available from Montell USA; ESD47, a polypropylene homopolymer having a melt flow rate of about 38 g/10 min, available from Union Carbide; and 6D43, a polypropylene-polyethylene copolymer having a melt flow rate of about 35 g/10 min, available from Union Carbide.

The at least one polymeric resin may be incorporated into the fibers of the present disclosure in an amount of greater than or equal to about 60 wt % relative to the total weight of the fibers. In one embodiment, the at least one polymer resin is present in the fibers in an amount ranging from about 60 to about 90 wt %. In another embodiment, the at least one polymer is present in the fibers in an amount ranging from about 75 to about 90 wt %. In a further embodiment, the at least one polymer is present in the fibers in an amount ranging from about 80 to about 90 wt %. In yet another embodiment, the at least one polymer is present in the fibers in an amount of greater than or equal to about 75 wt %.

Coated Calcium Carbonate

The nonwoven fibers in accordance with the present disclosure also comprise at least one filler. In one embodiment, the at least one filler is coated calcium carbonate, a filler commonly used in the formation of various polymeric products. In another embodiment, the at least one filler is chosen from the group consisting of coated calcium carbonate, talc, and clay.

Coated calcium carbonate products suitable for use in the fibers of the present disclosure include, but are not limited to, those commercially available. In a preferred embodiment, the coated calcium carbonate is chosen from those products sold under the names FiberLink™ 101S and 103S by Imerys, Inc. In another embodiment, the coated calcium carbonate is the product sold under the name MAGNUM GLOSS® by the Mississippi Lime Company. In a further embodiment, the coated calcium carbonate is the product sold under the name ALBAGLOS® by Specialty Minerals, Inc. In yet another embodiment, the coated calcium carbonate is the product sold under the name OMYACARB® by OMYA, Inc. In yet a further embodiment, the coated calcium carbonate is the product sold under the name HUBERCARB® by Huber, Inc. In a less preferred embodiment, the coated calcium carbonate is the product sold under the name Supercoat® by Imerys, Inc. The commercially available coated calcium carbonate products may be available in the form of dry powders having defined particle size ranges; however, not all commercial coated calcium carbonate products will exhibit a particle size and distribution appropriate for use in accordance with the present disclosure.

The particle size of the at least one filler may affect the maximum amount of filler that can be effectively incorporated into the nonwoven fibers disclosed herein, as well as the aesthetic properties and strength of the resulting products. In one embodiment, the at least one filler has an average particle size less than or equal to about 5 microns. In another embodiment, the at least one filler has an average particle size ranging from about 1 to about 5 microns. In a further embodiment, the at least one filler has an average particle size of about 1.5 microns. In yet another embodiment, the at least one filler has an average particle size less than or equal to about 4 microns. In yet a further embodiment, the at least one filler has an average particle size less than or equal to about 3 microns. In still another embodiment, the at least one filler has an average particle size less than or equal to about 2 microns. In still a further embodiment, the at least one filler has an average particle size less than or equal to about 1.5 microns. In another embodiment, the at least one filler has an average particle size less than or equal to about 1 micron. In a further embodiment, the at least one filler has an average particle size ranging from about 1 micron to about 4 microns. In yet another embodiment, the at least one filler has an average particle size ranging from about 1 micron to about 3 microns. In yet a further embodiment, the at least one filler has an average particle size ranging from about 1 micron to about 2 microns. In still another embodiment, the at least one filler has an average particle size ranging from about 0.5 microns to about 1.5 microns. Average particle size is defined herein as the $d_{50}$ as measured on a Microtrac 100 particle size analyzer. Products with average particle sizes outside the embodied ranges may also be incorporated into certain embodiments.

In addition, the at least one filler may be characterized by a "top cut" value. As used herein, the term "top cut" refers to the particle diameter at which 98% of the particles in the sample of filler have a smaller diameter as identified by a Microtrac 100 particle size analyzer. In one embodiment, the at least one filler has a top cut of about 15 microns or less. In another embodiment, the top cut is about 10 microns or less. In a further embodiment, the top cut is about 8 microns or less. In yet another embodiment, the top cut is about 6 microns or less. In yet a further embodiment, the top cut is about 4 microns or less. In still another embodiment, the top cut ranges from about 4 microns to about 15 microns. In still a further embodiment, the top cut ranges from about 4 microns to about 12 microns. In another embodiment, the top cut ranges from about 4 microns to about 10 microns. In a further embodiment, the top cut ranges from about 4 microns to about 8 microns. In yet another embodiment, the top cut ranges from about 4 microns to about 6 microns. In yet a further embodiment, the at least one filler has a top cut of not more than about 90% of the average diameter of the spunlaid fiber. In another embodiment, the at least one filler has a top cut of not more than about 95% of the average diameter of the spunlaid fiber. In a further embodiment, the at least one filler has a top cut of not more than about 100% of the average diameter of the spunlaid fiber.

Figure 2:
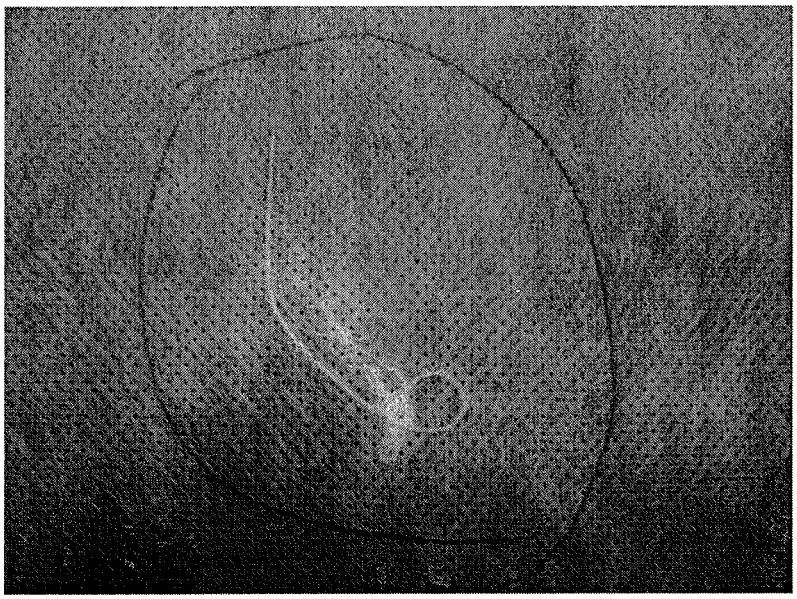
FIG. 2 is a photograph of a fiber web containing a "fiber clump" or "fiber bundle" caused by processing problems.

The particle size distribution of the at least one filler according to the present disclosure may be small enough so as to not significantly weaken the individual fibers and/or make the surface of the fibers abrasive, but large enough so as to create an aesthetically pleasing surface texture. For example, processing problems described as "fiber clumps" may result when fibers break in the drawing section of the line, e.g., the area in which the fibers are elongated from the 600 mm size exiting the spinneret hole of an extrusion apparatus down to an average 16 micron final fiber diameter. An example of a broken fiber caused by the addition of too large of calcium carbonate particles is illustrated in FIG. 1. When a fiber breaks it may collide with other fibers, creating a "bundle" or "clump." One example of a fiber clump is shown in FIG. 2.

Figure 3:
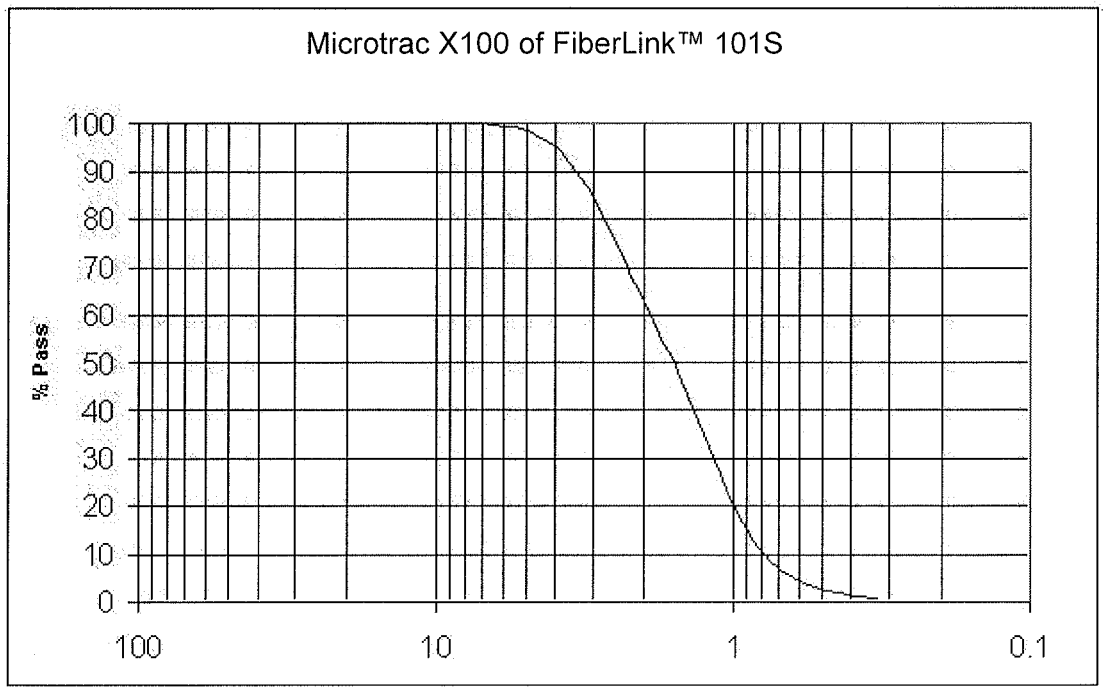
FIG. 3 is a graphical illustration showing a typical particle size distribution of a calcium carbonate product (Fiber-Link™ 101S manufactured in the United States by Imerys, Inc.) as disclosed herein.

FIG. 3 illustrates a exemplary particle size distribution (FiberLink™ 101S manufactured in the United States by Imerys, Inc.), wherein less than 5% of the total particles are greater than 5 microns or less than 0.5 microns. Particles above 5 microns may tend to weaken the structure, and particles less than 0.5 microns may tend to form agglomerates that lead to formation of structures greater than 5 microns. However, it has been shown that fillers such as coated calcium carbonate having a top cut of less than the diameter of the fibers may be effectively incorporated into the fibers.

The at least one filler may be coated with at least one organic material. In one embodiment, the at least one organic material is chosen from fatty acids, including but not limited to stearic acid, and salts and esters thereof, such as stearate. In another embodiment, the at least one organic material is ammonium stearate. In a further embodiment, the at least one organic material is calcium stearate. In yet another embodiment, the at least one organic material is stearic acid. In yet a further embodiment, the at least one organic material is salts and esters of fatty acids. The product FiberLink™ 101S sold by Imerys, Inc. is a non-limiting example of a calcium carbonate product coated with stearic acid.

Figure 4:
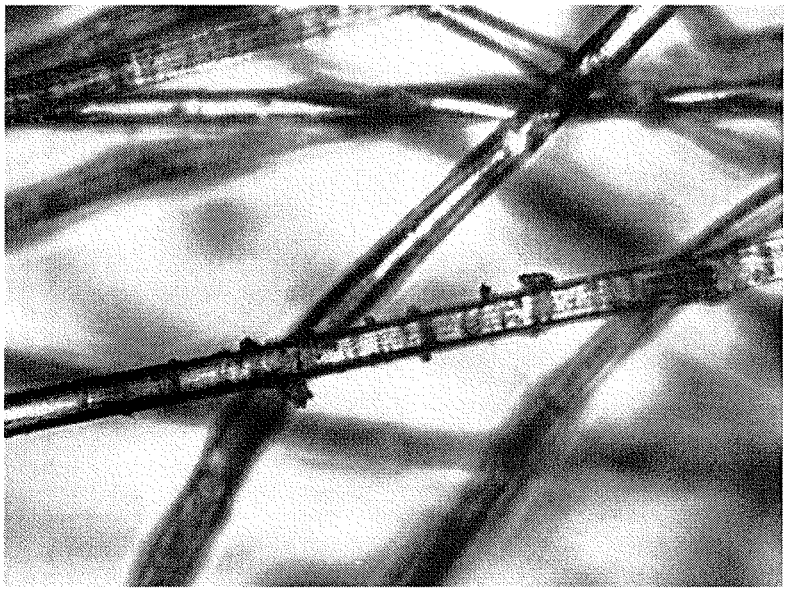
FIG. 4 is an SEM photograph of fibers made with 5% uncoated calcium carbonate showing uncoated calcium carbonate particles located on the outside of the fibers.
Figure 7:
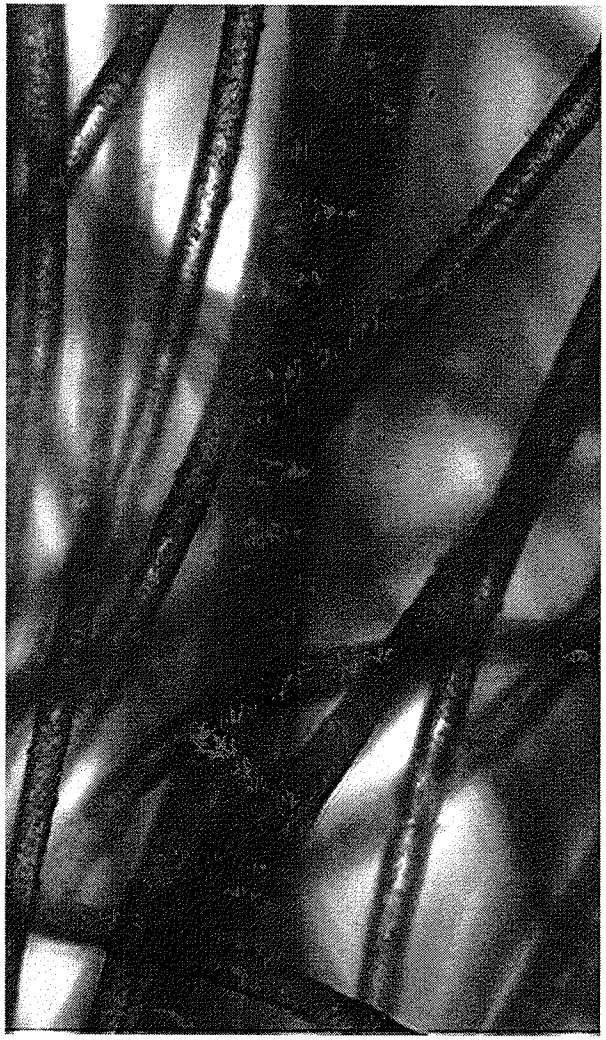
FIG. 7 is an SEM photograph of fibers made with 25% coated calcium carbonate in accordance with the present invention.

Surface coating the at least one filler with at least one organic material may serve to improve dispersion of the filler particles throughout the fiber and facilitate the overall production of the fibers. For example, the addition of uncoated calcium carbonate to at least one polymeric resin (as shown in FIG. 4), as opposed to coated calcium carbonate (as shown in FIG. 7), results in fibers having uncoated calcium carbonate particles located on the outside of the fibers, which is problematic because uncoated particles located on the outside of the fibers may cause the fibers to attach to metal components of the spinneret die holes and clog the exit holes, thus preventing the fibers from extruding properly if at all.

The amount of the at least one filler may negatively impact the strength and/or surface texture of the fibers once it exceeds a certain value. Thus, excessive amounts of the at least one filler should generally not be incorporated in the fibers. In one embodiment, the at least one filler is present in an amount less than about 40 wt % relative to the total weight of the fibers. In another embodiment, the at least one filler is present in an amount less than about 25 wt %. In a further embodiment, the at least one filler is present in an amount less than about 15 wt %. In yet another embodiment, the at least one filler is present in an amount less than about 10 wt %. In yet a further embodiment, the at least one filler is present in an amount ranging from about 5 wt % to about 40 wt %. In still another embodiment, the at least one filler is present in an amount ranging from about 10 wt % to about 25 wt %. In still another embodiment, the at least one filler is present in an amount ranging from about 10 wt % to about 15 wt %. In yet another embodiment, the at least one filler is present in an amount from about 5 wt % to about 40 wt % when the at least one filler has an average particle size of less than about 3 microns and/or a top cut of about 8 microns or less. In yet a further embodiment, the at least one filler is present in an amount from about 5 wt % to about 40 wt % when the at least one filler is coated and has an average particle size of less than about 100% of the average diameter of the spunlaid fibers. In another embodiment, the at least one filler is present in an amount less than about 35 wt %.

Optional Additives

In addition to the at least one polymeric resin and the at least one filler, the spunlaid fibers may further comprise at least one additive. The at least one additive may be chosen from those now known in the art or those hereafter discovered. In one embodiment, the at least one additive is chosen from additional mineral fillers, including but not limited to talc, gypsum, diatomaceous earth, kaolin, attapulgite, bentonite, montmorillonite, and other natural or synthetic clays. In another embodiment, the at least one additive is chosen from inorganic compounds, including but not limited to silica, alumina, magnesium oxide, zinc oxide, calcium oxide, and barium sulfate. In a further embodiment, the at least one additive is chosen from one of the group consisting of: optical brighteners; heat stabilizers; antioxidants; antistatic agents; anti-blocking agents; dyestuffs; pigments, including but not limited to titanium dioxide; luster improving agents; surfactants; natural oils; and synthetic oils.

Fiber Properties

Figure 5:
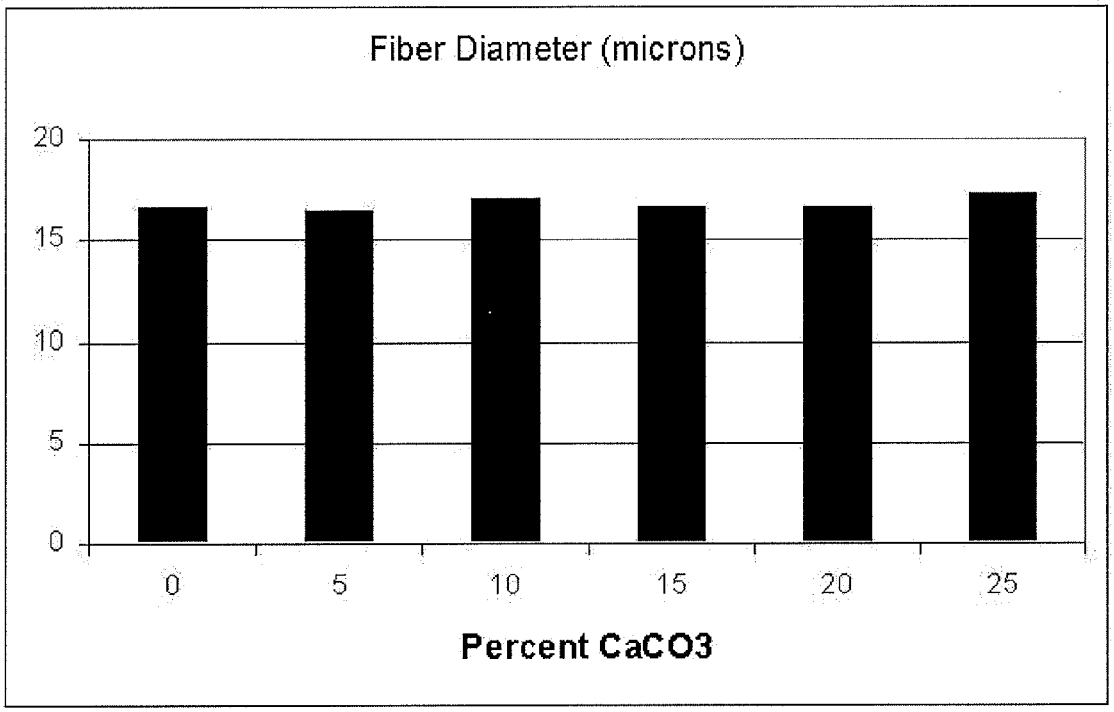
FIG. 5 is a chart comparing the fibers diameters produced in accordance with the present invention as examples using different loadings of filler.
Figure 6:
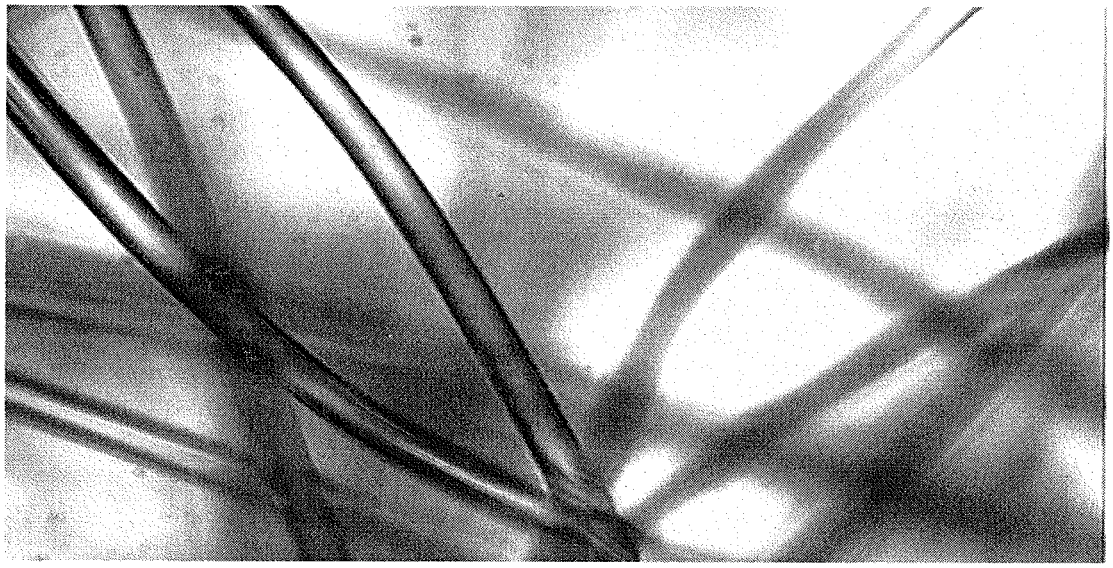
FIG. 6 is an SEM photograph of fibers made without any filler.

The exemplary fibers disclosed in Examples 1-12 herein were produced with the same process parameters and, therefore, have similar fiber diameters as shown in FIG. 5. The results shown in FIG. 5 illustrate those fibers are a typical size for commercial spunbond operations and the sizes do not vary significantly as a function of coated calcium carbonate content. FIGS. 6 and 7 are SEM photographs showing the fibers without coated calcium carbonate and after coated calcium carbonate has been added. It may be difficult to measure individual fiber properties in a spunlaid web, as the fibers are entangled during normal production. The process of separating an individual fiber for testing may damage the fiber so that the physical properties may be radically changed.

Processes for Producing Spunlaid Fibers

Spunlaid fibers, as discussed herein, may be produced according to any appropriate process or processes now known to the skilled artisan or hereafter discovered that results in the production of a nonwoven web of fibers comprising at least one polymeric resin. Two exemplary spunlaid processes are spunbonding and meltblowing. A spunlaid process may begin with heating the at least one polymeric resin at least to its softening point, or to any temperature suitable for the extrusion of the polymeric resin. In one embodiment, the at least one polymeric resin is heated to a temperature ranging from about 180° C. to about 240° C. In another embodiment, the at least one polymeric resin is heated to from about 200° C. to about 220° C.

Spunbonded fibers may be produced by any of various techniques now known or hereafter discovered in the art, including but not limited to general spun-bonding, flash-spinning, needle-punching, and water-punching processes. Exemplary spun-bonding processes are described in *Spunbond Technology Today 2—Onstream in the 90's* (Miller Freeman (1992)), U.S. Pat. No. 3,692,618 to Dorschner et al., U.S. Pat. No. 3,802,817 to Matuski et al., and U.S. Pat. No. 4,340,563 to Appel et al., each of which is incorporated herein by reference herein in its entirety.

Meltblown fibers may be produced by any of various techniques now known or hereafter discovered in the art. For example, meltblown fibers may be produced by extruding the at least one polymeric resin and attenuating the streams of resin by hot air to form fibers with a fine diameter and collecting the fibers to form spunlaid webs. One example of a meltblown process is generally described in U.S. Pat. No. 3,849,241 to Buntin, which is incorporated by reference herein in its entirety.

The at least one filler may be incorporated into the at least one polymeric resin using any method conventionally known in the art or hereafter discovered. For example, the at least one filler may be added to the at least one polymeric resin during any step prior to extrusion, for example, during or prior to the heating step. In another embodiment, a "masterbatch" of at least one polymeric resin and the at least one filler may be premixed, optionally formed into granulates or pellets, and mixed with at least one additional virgin polymeric resin before extrusion of the fibers. The at least one additional virgin polymeric resin may be the same or different from the at least one polymeric resin used to make the masterbatch. In certain embodiments, the masterbatch comprises a higher concentration of the at least one filler, for instance, a concentration ranging from about 20 to about 75 wt %, than is desired in the final product, and may be mixed with the at least one additional polymeric resin in an amount suitable to obtain the desired concentration of at least one filler in the final spunlaid fiber product. For example, a masterbatch comprising about 50 wt % coated calcium carbonate may be mixed with an equal amount of at least one virgin polymeric resin to produce a final product comprising about 25 wt % coated calcium carbonate. The masterbatch may be mixed and pelletized using any apparatus known in the art or hereafter discovered, for example, a ZSK 30 Twin Extruder may be used to mix and extrude the coated calcium carbonate and at least one polymer resin masterbatch, and a Cumberland pelletizer may be used to optionally form the masterbatch into pellets.

Once the at least one filler or masterbatch is mixed with the at least one polymeric resin, the mixture may be extruded continuously through at least one spinneret to produce long filaments. The extrusion rate may vary according to the desired application. In one embodiment, the extrusion rate ranges from about 0.4 g/min to about 2.5 g/min. In another embodiment, the extrusion rate ranges from about 0.8 to about 1.2 g/min.

The extrusion temperature may also vary depending on the desired application. In one embodiment, the extrusion temperature ranges from about 180 to about 235° C. In another embodiment, the extrusion temperature ranges from about 200 to about 215° C. The extrusion apparatus may be chosen from those conventionally used in the art, for example, the Reicofil 2 apparatus produced by Reifenhauser. The spinneret of the Reicofil 2, for example, contains 4036 holes, approximately 0.6 millimeters in diameter, in a pattern with approximately 19 alternating rows across the die.

After extrusion, the filaments may be attenuated. Spunbonded fibers, for example, may be attenuated by high-speed drafting, in which the filament is drawn out and cooled using a high velocity gas stream, such as air. The gas stream may create a draw force on the fibers that draws them down into a vertical fall zone to the desired level. Meltblown fibers may, for example, be attenuated by convergent streams of hot air to form fibers of fine diameter.

After attenuation, the fibers may be directed onto a foraminous surface, such as a moving screen or wire. The fibers may then be randomly deposited on the surface with some fibers laying in a cross direction, so as to form a loosely bonded web or sheet. In certain embodiments, the web is held onto the foraminous surface by means of a vacuum force. At this point, the web may be characterized by its basis weight, which is the weight of a particular area of the web, expressed in grams per square meter (gsm). In one embodiment, the basis weight of the web ranges from about 10 to about 55 gsm. In another embodiment, the basis weight of the web ranges from about 15 to about 30 gsm.

Figure 8:
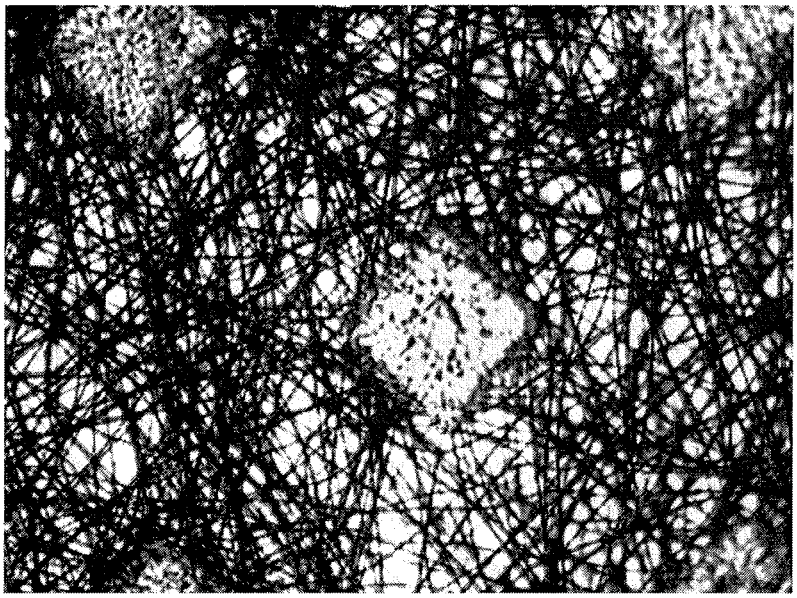
FIG. 8 is a SEM photograph of a fiber web embossed with diamond shapes.

Once a web is formed, it may be bonded according to any method conventionally used in the art or hereafter discovered, for example, melting and/or entanglement methods, such as thermal point bonding, ultrasonic bonding, hydroentanglement, and through-air bonding. Thermal point bonding is a commonly used method and generally involves passing the web of fibers through at least one heated calender roll to form a sheet. In certain embodiments, thermal point bonding may involve two calendar rolls where one roll is embossed and the other smooth. The resulting web may have thermally embossed points corresponding to the embossed points on the roll. For example, the web shown in FIG. 8 has diamond shapes measuring approximately 0.5 mm on each side embossed in a 12×12 pattern per square inch.

After bonding, the resulting sheet may optionally undergo various post-treatment processes, such as direction orientation, creping, hydroentanglement, and/or embossing processes. The optionally post-treated sheet may then be used to manufacture various nonwoven products. Methods for manufacturing nonwoven products are generally described in the art, for example, in *The Nonwovens Handbook*, The Association of the Nonwoven Industry (1988) and the *Encyclopaedia of Polymer Science and Engineering*, vol 10, John Wiley and Sons (1987).

Spunlaid fibers may have an average diameter ranging from about 0.5 microns to about 35 microns or more. In one embodiment, spunbonded fibers have a diameter ranging from about 5 microns to about 35 microns. In another embodiment, spunbonded fibers have a diameter of about 15 microns. In yet another embodiment, spunbonded fibers have a diameter of about 16 microns. In one embodiment, meltblown fibers have a diameter ranging from about 0.5 microns to about 30 microns. In another embodiment, meltblown fibers have a diameter of about 2 microns to about 7 microns. In a further embodiment, meltblown fibers have a smaller diameter than spunbonded fibers of the same or a similar composition. In one embodiment, the spunbonded or meltblown fibers range in size from about 0.1 denier to about 120 denier. In another embodiment, the fibers range in size from about 1 denier to about 100 denier. In a further embodiment, the fibers range in size from about 1 to about 5 denier. In yet another embodiment, the fibers are about 100 denier in size.

Spunlaid fibers according to the present invention may have an increased density over spunlaid fibers made without at least one coated filler. The increase in density may vary depending on the amount of the at least one coated filler used in the spunlaid fibers of the present invention. In one embodiment, the increase is from about 5% to about 40%. In another embodiment, the increase is from about 10% to about 30%. In a further embodiment, the increase is about 30%. For example, spunlaid fibers from pure polypropylene may have a density of about 0.9 g/cc and float in water, while spunlaid fibers with about 20% of at least one coated filler chosen from coated calcium carbonate may have a density of about 1.25 g/cc and not float in water. The increase in density of the spunlaid fibers may be useful in several applications, including in products such as ground cover that are not intended to readily float.

Some thermoformed spunlaid fibers (e.g., extrusion spun or melt spun thermoplastic fibers) according to the present invention may have a different charge density (electrostatic effect) than thermoformed spunlaid fibers made without at least one coated filler. The difference in charge density may vary depending on the amount of the at least one coated filler used in the spunlaid fibers of the present invention. The difference in electrostatic effect may be observed, for example, by rubbing the web on human hair or by simply picking up the webs. The difference in charge density may be revealed in an increase in positive voltage, a decrease in negative voltage, a decrease from a positive charge voltage to a negative charged voltage, or an increase from a negative charged voltage to a positive charge voltage. In one embodiment, the difference is from about 10 to about 100 volts. In another embodiment, the difference is about 90 volts. In a further embodiment, the difference is about 45 volts. In yet another embodiment, the difference is from a positive charge density on spunlaid fibers not made according to the present invention, to a negative charge density on spunlaid fibers made according to the present invention. In one embodiment, the charge density of spunlaid fibers according to the present invention is from about −10 to about −100 volts. In another embodiment, the charge density is from about −20 to about −70 volts. In a further embodiment the charge density is about −25 volts. In yet another embodiment, the charge density is about −60 volts. The difference in charged density of the thermoformed spunlaid fibers, or the overall charged density of the spunlaid fibers, according to the present invention may be useful in several applications, including in produced such as filtration media or dust mops.

Testing

The fibers disclosed herein may be tested by any number of various methods and for any number of various properties. In one embodiment, the tests described in ASTM D3822 may be used.

Dart Drop Test

The Dart Drop test is carried out by dropping darts onto the nonwoven sheet from a standard height. The drop is repeated with darts having steadily increasing weights attached to them. The end point of the testing is defined as the weight at which half of the darts form holes where the dart impacted the fabric. This protocol is described more thoroughly, for example, in ASTM 1709.

Tensile Strength Test

Spunlaid fibers are randomly distributed from an extrusion apparatus onto a moving web to produce nonwoven fabrics. However, more fibers align in the direction the web is moving, or in the machine direction (MD), than align in a direction perpendicular to the machine, called the cross machine direction (CD) or transverse direction (TD). This may cause the nonwoven fabrics to be stronger in the machine direction than in the cross machine or transverse direction.

The tensile strength test is carried out by cutting one-inch wide strips of the nonwoven fabric and stretching the fabric separately along its machine direction and along its cross machine direction until it breaks. The fabric may be stretched using standard equipment, such as that sold by Instron. The amount of force necessary to fracture the fabric is referred to as the maximum load. The Instron data also indicates the elongation where the nonwoven fabric breaks.

This is referred to as the elongation to break or maximum percent strain. These tests are conventionally conducted in both the machine direction and cross machine direction. Fabrics with tensile strength ratios (MD:CD) of about 1, also called "square" fabrics, may be preferred in the art.

Density

An estimated relative density of two spunlaid webs may be calculated by measuring the thickness of an embossing point on each of the two spunlaid webs and taking their ratio.

Charge Density

Charge density of spunlaid webs may be measured by charging a web with a corona charging system (such as the TANTRET Tech-1) and then testing for surface charge using an appropriate voltmeter and probe (such as a Monroe Model 244 Isoprobe Electrostatic Voltmeter with a 1017E Probe). The measurement system may be interfaced with an appropriate data gathering computer (such as an IBM AT computer using DT 2801 I/O system (Data Translation Inc., Marlborough, Mass.)). One technique for measuring charged density is described in Tsai et al., "Different Electrostatic Methods for Making Electret Filters," 54 *J. Electrostatics* 333-341 (2002), which is incorporated herein by reference in its entirety.

Other than in the examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present disclosure. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, unless otherwise indicated the numerical values set forth in the specific examples are reported as precisely as possible. Any numerical value, however, inherently contain certain errors resulting from the standard deviation found in their respective testing measurements.

The headers used in this specification are presented for the convenience of the reader and not intended to be limiting of the inventions described herein. By way of non-limiting illustration, examples of certain embodiments of the present disclosure are given below.

EXAMPLES

Examples 1-6

A masterbatch comprising 50 wt % coated calcium carbonate (FiberLink™ 101S manufactured in the United States by Imerys, Inc.) and 50 wt % polypropylene homopolymer (Exxon 3155) was prepared using a ZSK 30 Twin Screw Extruder and pelletized in a Cumberland pelletizer. FiberLink™ 101S has an average particle size of 1.5 microns and a top cut around 8 microns. The resulting product was then combined with virgin Exxon 3155 polymer in a Reicofil 2 extruder to produce fibers. The fibers were collected as a spunbonded web and subsequently point bonded to produce nonwoven fabrics comprising from 0 to 25 wt % coated calcium carbonate. Fabrics comprising 0 and 5 wt % calcium carbonate were included as comparative examples. The resulting fabrics all exhibited a basis weight of 25 gsm, except for the fabric comprising 25 wt % coated calcium carbonate, which had a basis weight of 29 gsm.

Fiber clumps were observed in nonwoven fabrics comprising 25% FiberLink™ 101S. However, it is possible that processing problems such as this observed at high concentrations of coated calcium carbonate could have been corrected, for example, by decreasing the average particle size and/or the top cut of the calcium carbonate filler.

Each fabric was subjected to dart drop and tensile strength tests, the results of which are illustrated in FIGS. 9-13.

Figure 9:
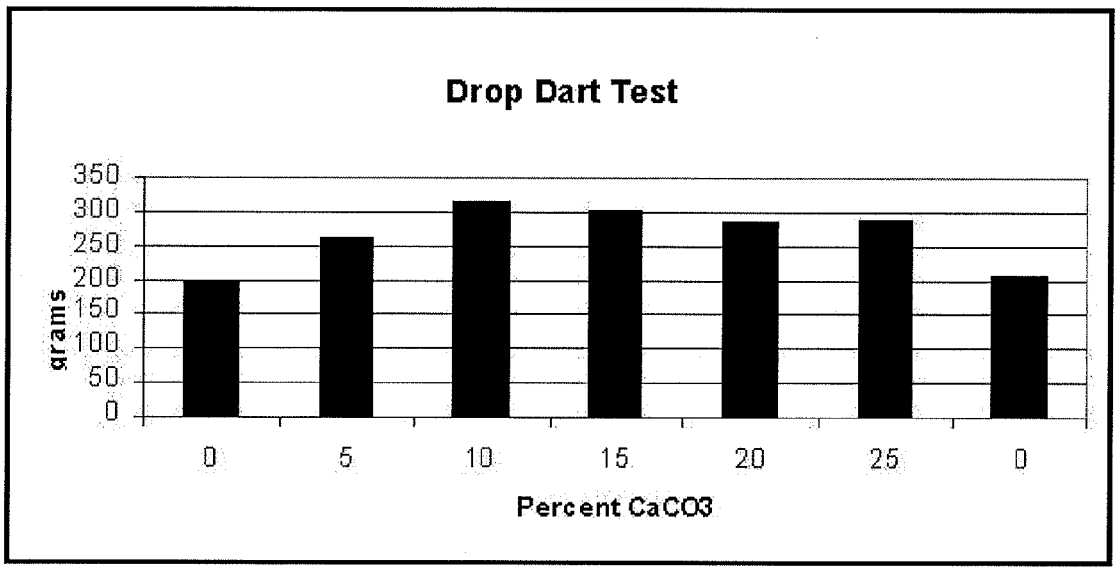
FIG. 9 is a graphical illustration of the results of a drop dart test conducted on a nonwoven fabric produced according to Examples 1-6 of the present disclosure.

As shown in FIG. 9, the dart drop test results indicate that the impact properties of the nonwoven fabric are actually improved by the addition of coated calcium carbonate, most notably in the range of 10 to 25 wt % coated calcium carbonate.

Figure 10:
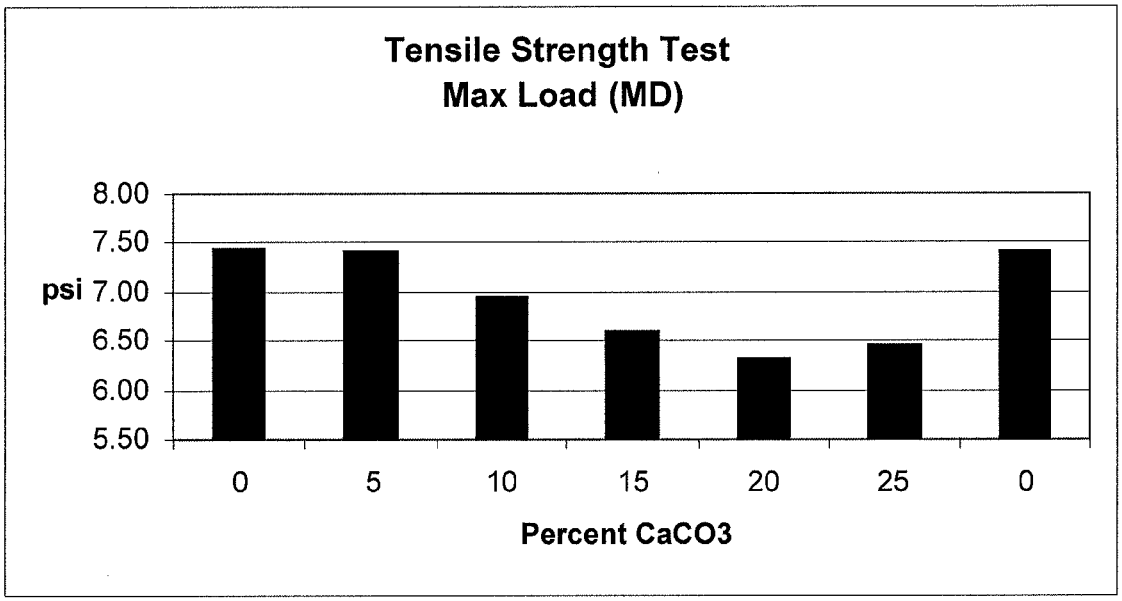
FIG. 10 is a graphical illustration providing the maximum load (machine direction) results of a tensile strength test conducted on a nonwoven fabric produced according to Examples 1-6 of the present disclosure.
Figure 11:
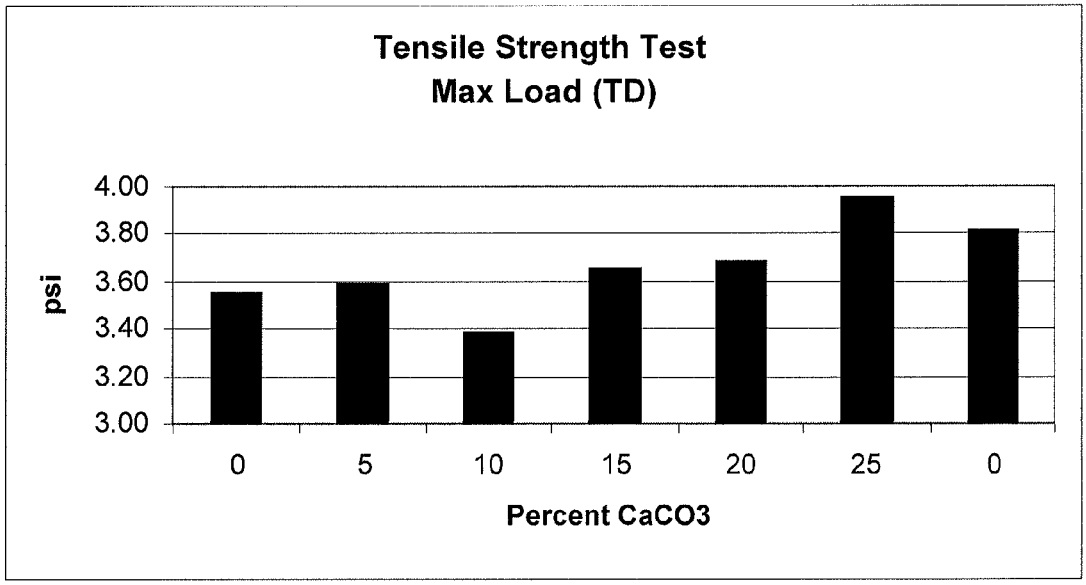
FIG. 11 is a graphical illustration providing the maximum load (transverse direction) results of a tensile strength test conducted on a nonwoven fabric produced according to Examples 1-6 of the present disclosure.

As indicated by FIGS. 10 and 11, the tensile properties (maximum load) in both the machine and transverse directions do not appear to be substantially adversely affected by the addition of coated calcium carbonate.

Figure 12:
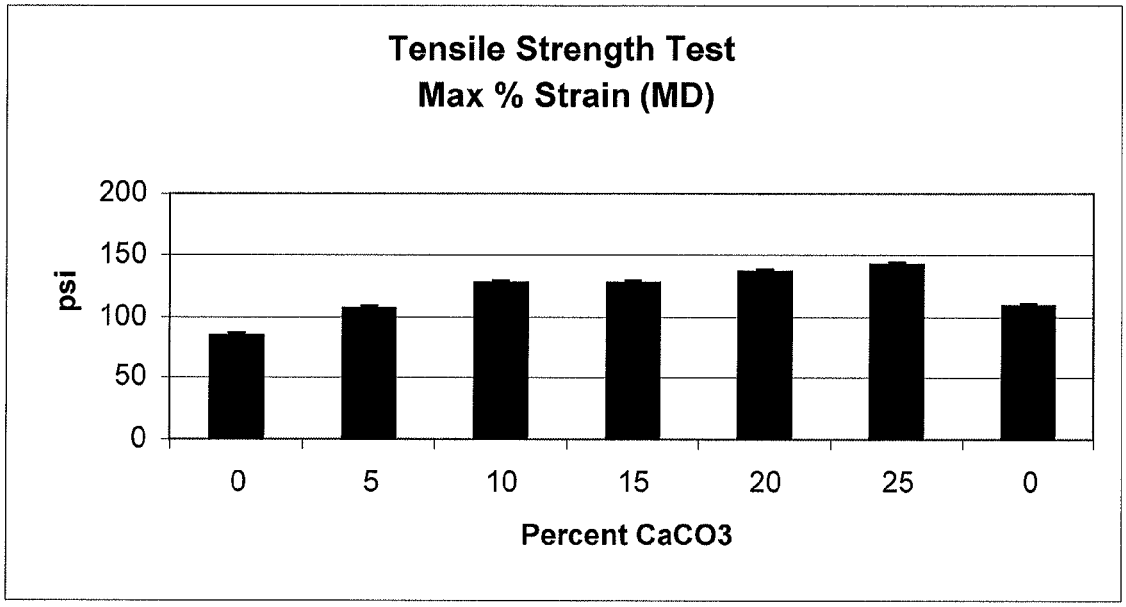
FIG. 12 is a graph providing the maximum percent strain (machine direction) results of a tensile strength test conducted on a nonwoven fabric produced according to Examples 1-6 of the present disclosure.
Figure 13:
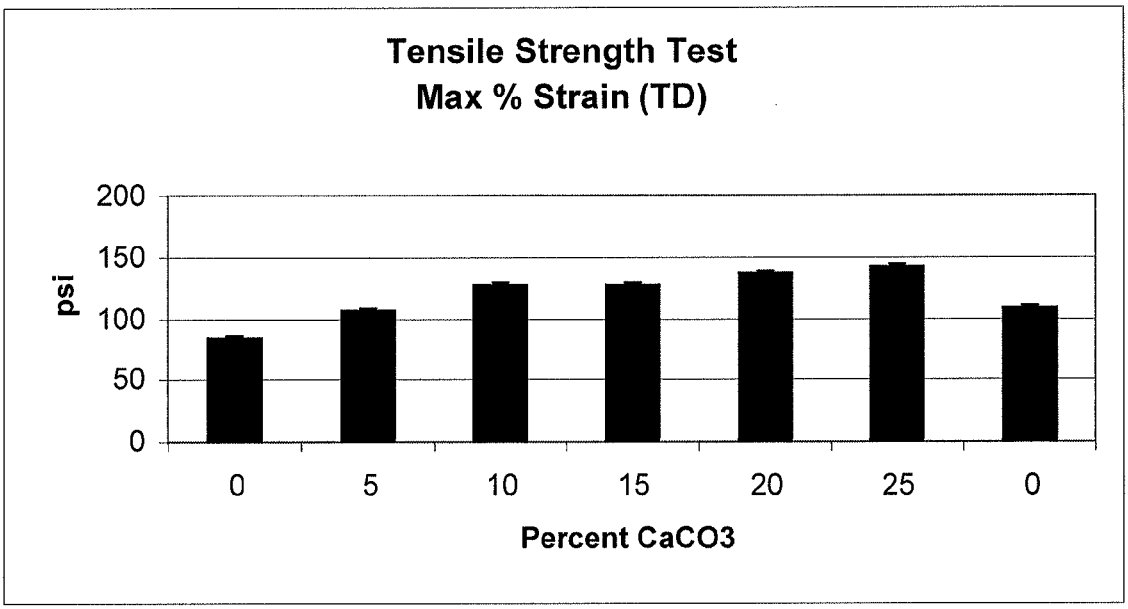
FIG. 13 is a graphical illustration providing the maximum percent strain (transverse direction) results of a tensile strength test conducted on a nonwoven fabric produced in accordance Examples 1-6 of the present disclosure.

Finally, FIGS. 12 and 13 illustrate that the elongation properties (maximum percent strain) in both the machine and transverse directions are improved with the addition of coated calcium carbonate, again, most notably in the range of 10 to 25 wt % coated calcium carbonate.

Examples 7-10

Using the same machinery and procedure as described above in Examples 1-6, nonwoven fabrics comprising 0 wt %, 5 wt %, or 20 wt % coated with one of two calcium carbonates (FiberLink 101S™ manufactured in the United States by Imerys, Inc. and FiberLink™ 103S from Imerys, Inc.) were produced. FiberLink™ 103S has an average particle size of about 3 microns and has a top cut of about 15 microns. The moving belt was run progressively faster to compensate for adding calcium carbonate with a density three times as high as the polypropylene resin. No processing issues were experienced when processing these fibers.

Figure 14:
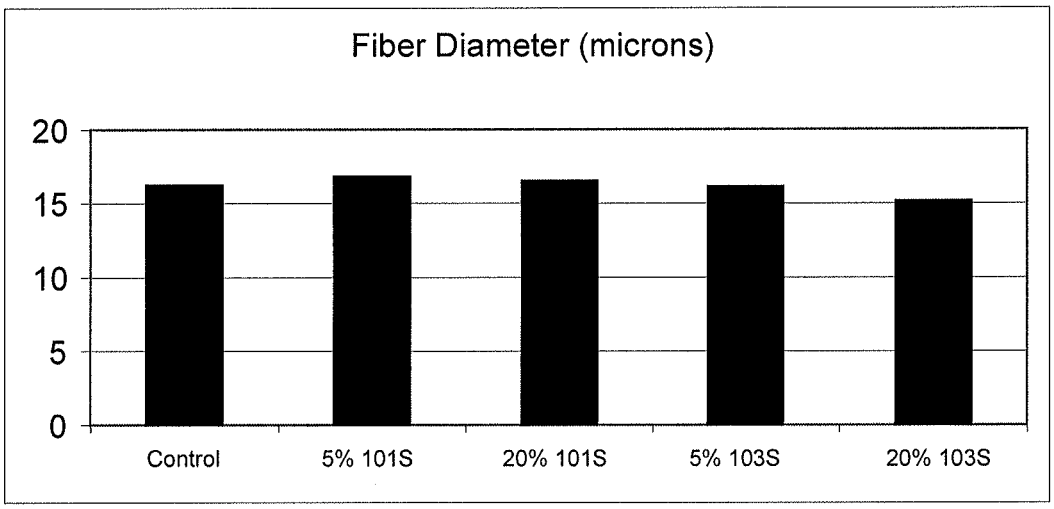
FIG. 14 is a chart comparing the diameters of fibers produced as described in Examples 7-11 using different loadings of filler.
Figure 15:
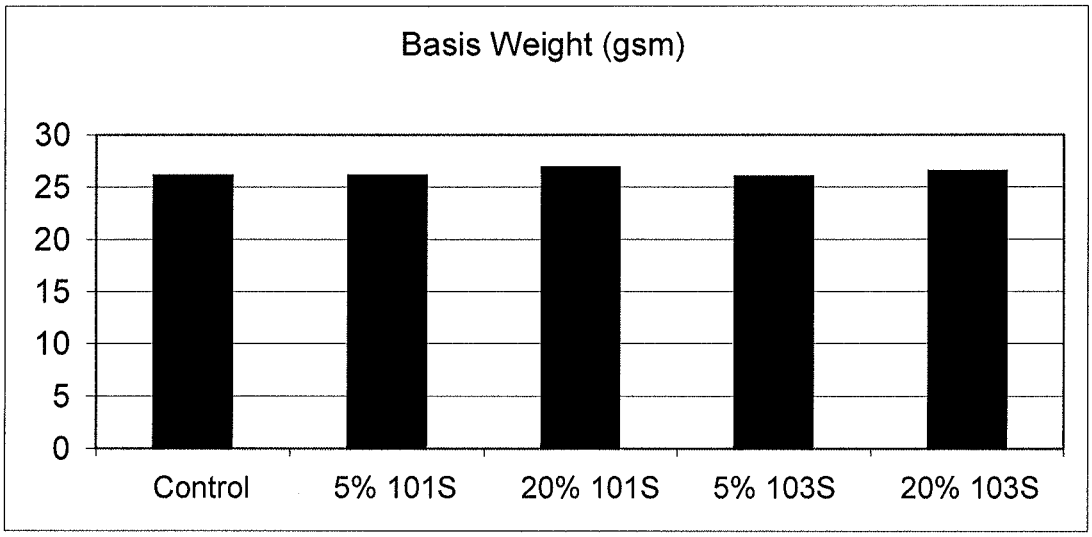
FIG. 15 is a chart comparing the basis weight of the fabrics produced according to Examples 7-11.

As illustrated in FIG. 14, the resulting fibers ranged from about 15 microns to about 16 microns in diameter, demonstrating that the calcium carbonate did not alter the size of the fibers. More particularly, the results of FIG. 14 illustrate those fibers are a typical size for commercial spunbond operations and the sizes do not vary significantly as a function of coated calcium carbonate content. In addition, the basis weight did not vary among Examples 7-10, with the fabrics all exhibiting an average basis weight of about 26 gsm, as illustrated in FIG. 15.

Each fabric was subjected to dart drop and tensile strength tests, the results of which are illustrated in FIGS. 16-20.

Figure 16:
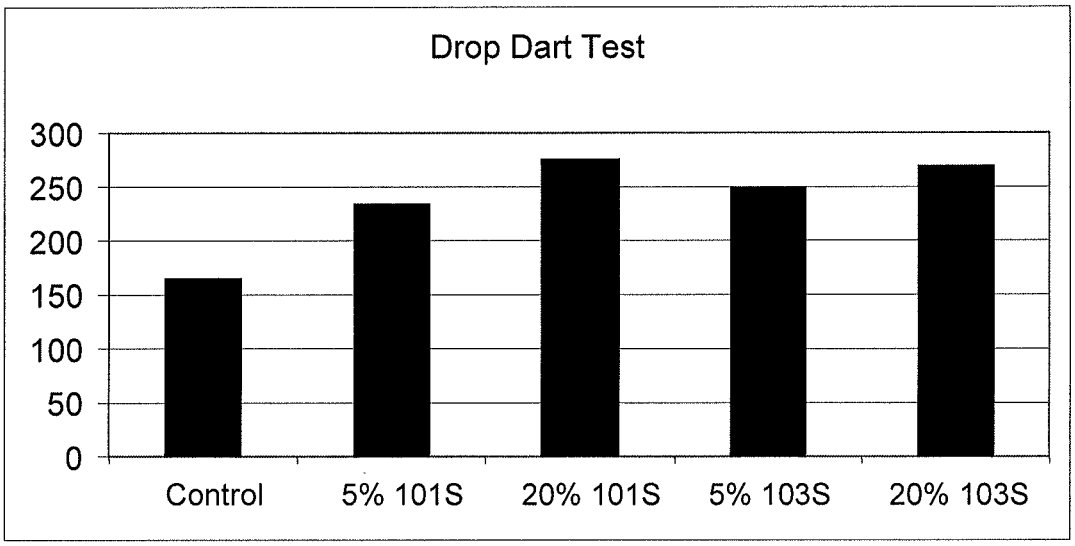
FIG. 16 is a graphical illustration of the results of a drop dart test conducted on a nonwoven fabric produced according to Examples 7-11 of the present disclosure.

As shown in FIG. 16, the dart drop test results indicate that the impact properties of the nonwoven fabric are improved by the addition of coated calcium carbonate, for example in amounts of 5% and 20%.

Figure 17:
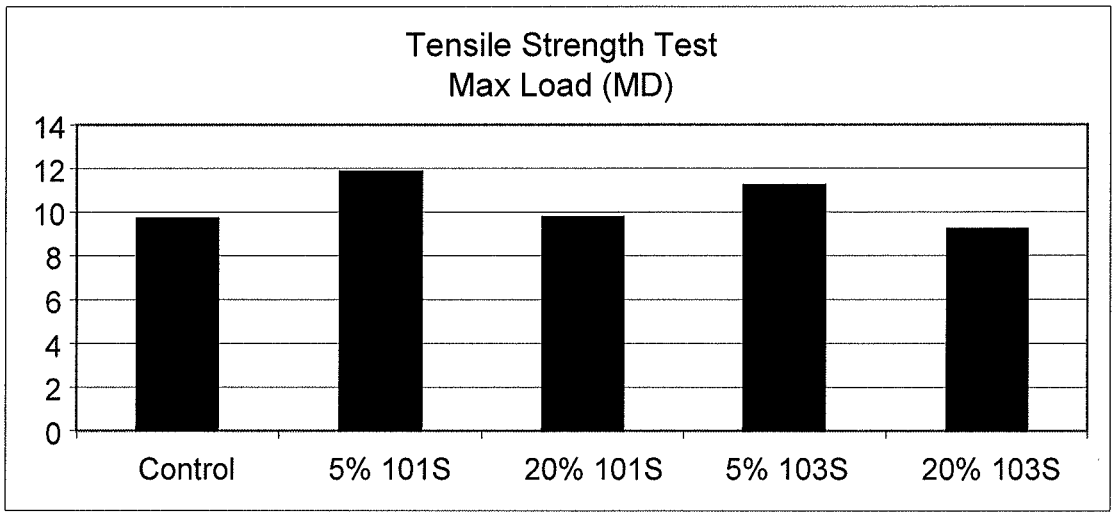
FIG. 17 is a graphical illustration providing the maximum load (machine direction) results of a tensile strength test conducted on a nonwoven fabric produced according to Examples 7-11 of the present disclosure.
Figure 18:
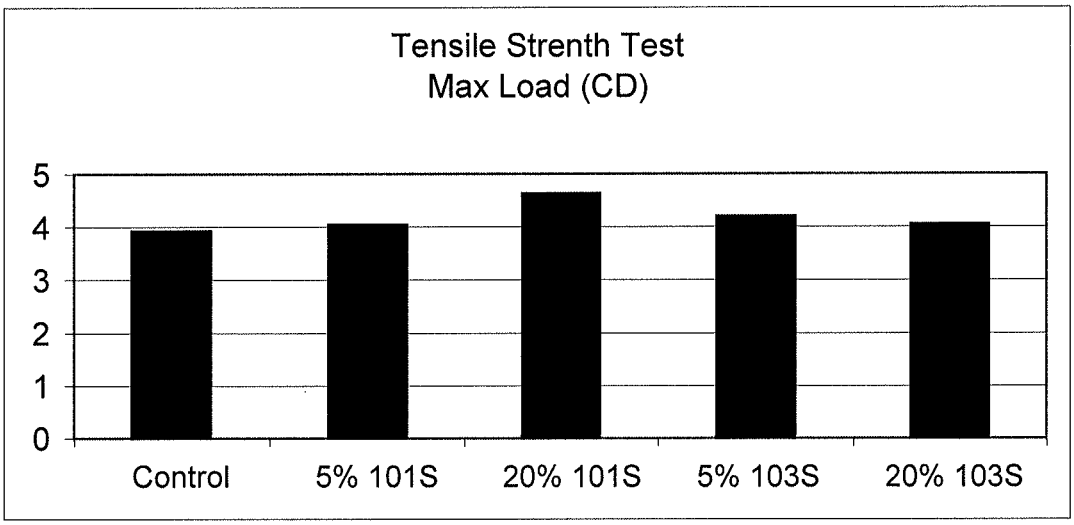
FIG. 18 is a graphical illustration providing the maximum load (cross direction) results of a tensile strength test conducted on a nonwoven fabric produced according to Examples 7-11 of the present disclosure.

As indicated by FIGS. 17 and 18, the tensile properties (maximum load) in both the machine and cross directions appear to be improved in some examples with the addition of coated calcium carbonate and in other examples do not appear to be substantially adversely affected by the addition of calcium carbonate.

Figure 19:
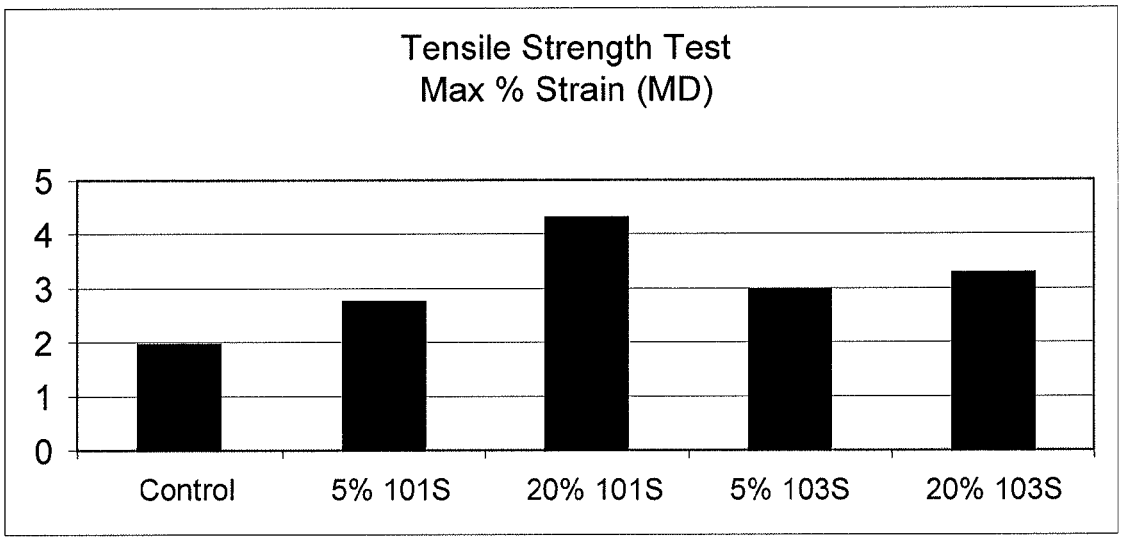
FIG. 19 is a graph providing the maximum percent strain (machine direction) results of a tensile strength test conducted on a nonwoven fabric produced according to Examples 7-11 of the present disclosure.
Figure 20:
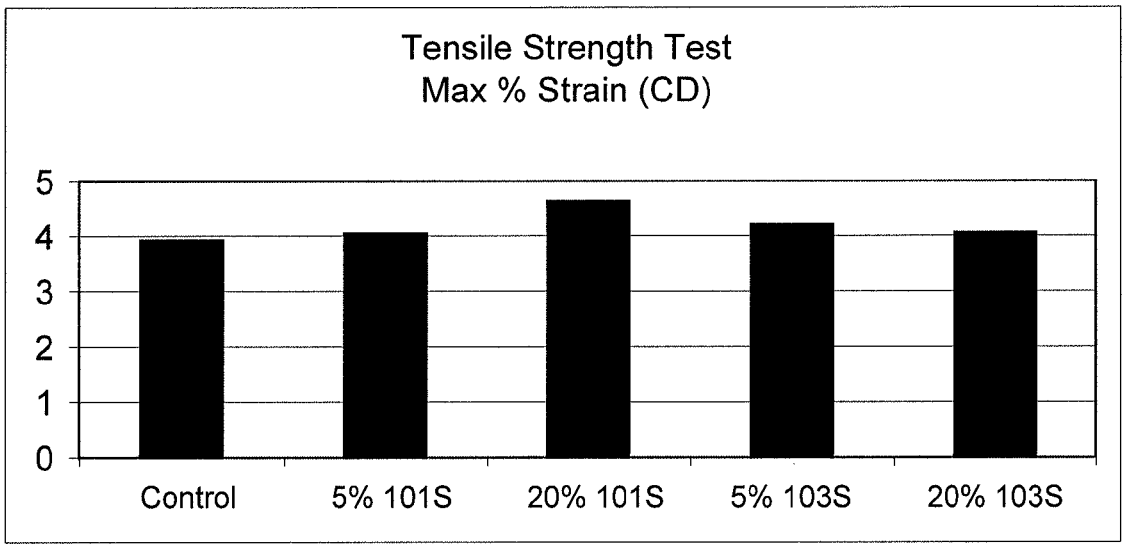
FIG. 20 is a graphical illustration providing the maximum percent strain (cross direction) results of a tensile strength test conducted on a nonwoven fabric produced according to Examples 7-11 of the present disclosure.

Finally, FIGS. 19 and 20 illustrate that the elongation properties (maximum percent strain) in both the machine and cross directions are improved with the addition of coated calcium carbonate, again, for example in amounts of 5% and 20%.

Examples 11-12

Under the same procedures as described in Examples 1-6, for Example 11 polypropylene resin was combined with 0%, 5%, or 20% KOTOMITE® (a coated calcium carbonate manufactured by Imerys, Inc.). Standard KOTOMITE® has an average particle size of about 3 microns and a top cut of about 20 microns, which is higher than that of FiberLink™ 103S. The small size difference between KOTOMITE® and FiberLink™ 103S is important because the fibers produced average about 16 microns in diameter. At the higher concentration, the 20 micron particles caused the fibers to fracture during the drawing process.

The 5% KOTOMITE® experiment ran without obvious defects. With the addition of 20% KOTOMITE®, the fibers fell vertically from the die to a point about 24 inches below the spinneret where some of the fibers broke as shown in FIG. 1. Because of the random air flow, once a fiber broke, it immediately collided with other fibers, creating a "bundle." An example of a fiber bundle is illustrated in FIG. 2. This flaw is considered a defect in the textile industry and, therefore, KOTOMITE® may be an unlikely additive at higher concentrations.

In addition, ATOMITE®, a type of uncoated calcium carbonate manufactured by Imerys, Inc., which has a top cut of about 15 microns, was mixed with polypropylene resin at concentrations of 0 wt %, 5 wt %, or 20 wt % for Example 12. However, few fibers were produced from either 5 wt % or 20 wt % ATOMITE® because the mixtures immediately began clogging the spinneret openings. As shown in FIG. 4, it was observed from the few fibers produced that the uncoated calcium carbonate particles resided on the outside of the fibers. ATOMITE® may be an unlikely additive at these concentrations primarily because the calcium carbonate it is uncoated. In contrast, examples 7-10 show that production of fibers comprising coated calcium carbonate, also having a top cut of about 15 microns, did not result in clogging. Since Atomite and FiberLink™ 103S have similar top cut values (about 15 microns), it can be seen that whether the calcium carbonate is coated may also play a role in a successful fiber production.

Example 13

Webs comprising 0%, 5%, and 20% coated calcium carbonate (FiberLink™ 101S manufactured in the United Stated by Imerys, Inc.) were first charged with a corona charging system (TANTRET Tech-1) and then tested for surface charge using an A Monroe Model 244 Isoprobe Electrostatic Voltmeter with a 1017E Probe. The measurement system was interfaced with an IBM AT computer using DT 2801 I/O system (Data Translation Inc., Marlborough, Mass.). The technique was followed as described in Tsai et al., "Different Electrostatic Methods for Making Electret Filters," 54 J. Electrostatics 333-341 (2002).

Figure 21:
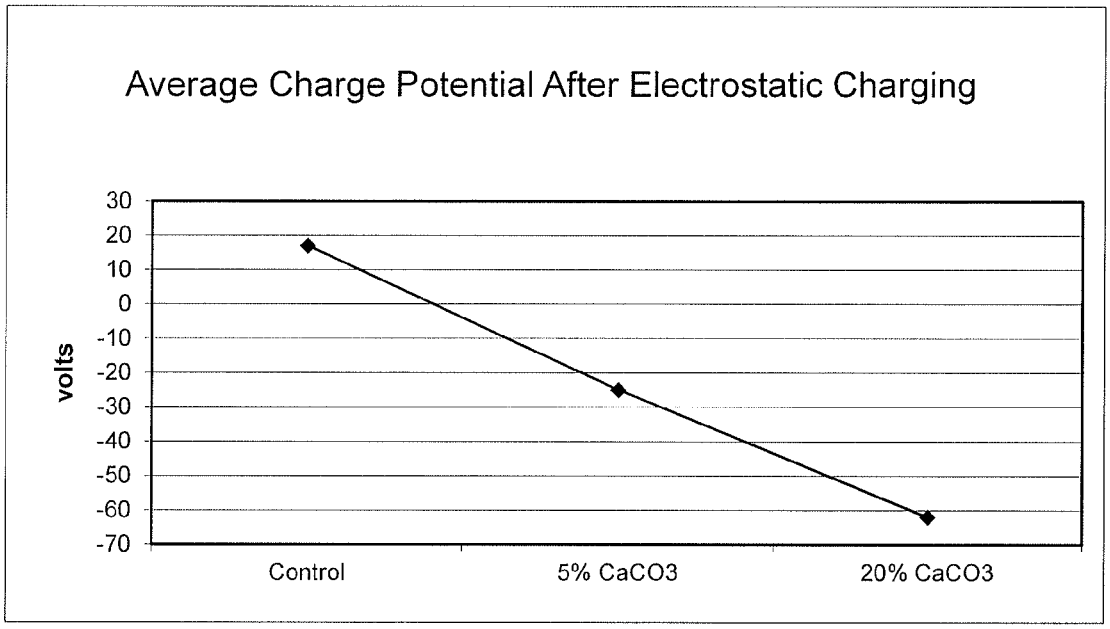
FIG. 21 is a graphical illustration showing the difference in potential after electrostatic charging webs not containing coated calcium carbonate and webs containing 5% and 20% coated calcium carbonate.

FIG. 21 shows the difference in potential after electrostatic charging webs not comprising coated calcium carbonate (i.e., not in accordance with the present invention) and webs comprising 5% and 20% coated calcium carbonate in accordance with the present invention.

What is claimed is:

1. A process for producing a nonwoven fabric comprising:
(a) mixing at least one polymeric resin with coated calcium carbonate having an average particle size of less than or equal to about 3 microns;
(b) heating the mixture at least to the softening point of the at least one polymeric resin;
(c) extruding the mixture to form fibers directly onto a foraminous surface to form a spunlaid web; and
(d) bonding the spunlaid web to produce a nonwoven fabric;
wherein the calcium carbonate is present in the nonwoven fabric in an amount less than about 40 wt %, relative to the total weight of the fabric.

2. The process of claim 1, wherein the nonwoven fabric has a basis weight ranging from about 15 to about 30 gsm.

3. The process of claim 1, wherein the spunlaid web is bonded by a method chosen from at least one of thermal point bonding, ultrasonic bonding, hydroentanglement, and through-air bonding methods.

4. The process of claim 1, further comprising at least one post-treatment process chosen from direction orientation, creping, hydroentanglement, and embossing processes.

5. The process of claim 1, where in the calcium carbonate has a top cut of about 15 microns or less.

6. The process of claim 1, wherein the calcium carbonate has a top cut ranging from about 4 microns to about 15 microns.

7. The process of claim 1, wherein the calcium carbonate has a top cut of not more than about 100% of the diameter of the spunlaid fiber.

8. A process for producing a nonwoven fabric comprising:
(a) producing a masterbatch by mixing and extruding at least one first polymeric resin with calcium carbonate having an average particle size of less than or equal to about 3 microns;
(b) mixing the masterbatch with at least one second polymeric resin to form a resulting mixture, and
(c) extruding the resulting mixture to form spunlaid fibers directly onto a foraminous surface to form a spunlaid web; and
(d) bonding the spunlaid web to produce a nonwoven fabric;
wherein the calcium carbonate is present in the nonwoven fabric in an amount less than 40 wt %, relative to the total weight of the fibers.

9. The process of claim 8, wherein the masterbatch is pelletized before it is mixed with the at least one second polymeric resin.

10. The process of claim 8, where in the calcium carbonate has a top cut of about 15 microns or less.

11. The process of claim 8, wherein the calcium carbonate has a top cut ranging from about 4 microns to about 15 microns.

12. The process of claim 8, wherein the calcium carbonate has a top cut of not more than about 100% of the diameter of the spunlaid fiber.

13. A process for producing a nonwoven fabric comprising:
(a) mixing at least one polymeric resin with coated calcium carbonate having a top cut of about 15 microns or less;
(b) heating the mixture at least to the softening point of the at least one polymeric resin;
(c) extruding the mixture to form fibers directly onto a foraminous surface to form a spunlaid web; and
(d) bonding the spunlaid web to produce a nonwoven fabric;
wherein the calcium carbonate is present in the nonwoven fabric in an amount less than 40 wt %, relative to the total weight of the fibers.

14. The process of claim 13, wherein the nonwoven fabric has a basis weight ranging from about 15 to about 30 gsm.

15. The process of claim 13, wherein the spunlaid web is bonded by a method chosen from at least one of thermal point bonding, ultrasonic bonding, hydroentanglement, and through-air bonding methods.

16. The process of claim 13, further comprising at least one post-treatment process chosen from direction orientation, creping, hydroentanglement, and embossing processes.

17. The process of claim 13, wherein the calcium carbonate has an average particle size of less than or equal to about 5 microns.

18. The process of claim 13, wherein the calcium carbonate has an average particle size ranging from about 1 micron to about 5 microns.

19. The process of claim 13, wherein the calcium carbonate has an average particle size ranging from about 0.5 microns to about 1.5 microns.

20. A process for producing a nonwoven fabric comprising:

(a) producing a masterbatch by mixing and extruding at east one first polymeric resin with coated calcium carbonate having a top cut of about 15 microns or less;

(b) mixing the masterbatch with at least one second polymeric resin to form a resulting mixture, and (c) extruding the resulting mixture to form spunlaid fibers directly onto a foraminous surface to form a spunlaid web; and (d) bonding the spunlaid web to produce a nonwoven fabric;

wherein the calcium carbonate is present in the nonwoven fabric in an amount less than about 40 wt %, relative to the total weight of the fibers.

21. The process of claim 20, wherein the masterbatch is pelletized before it is mixed with the at least one second polymeric resin.

22. The process of claim 20, wherein the calcium carbonate has an average particle size of less than or equal to about 5 microns.

23. The process of claim 20, wherein the calcium carbonate has an average particle size ranging from about 1 micron to about 5 microns.

24. The process of claim 20, wherein the calcium carbonate has an average particle size ranging from about 0.5 microns to about 1.5 microns.

* * * * *